US005632175A

United States Patent [19]

Green et al.

[11] Patent Number: 5,632,175

[45] Date of Patent: May 27, 1997

[54] REBAR FABRICATING APPARATUS

[76] Inventors: Paul O. Green; Robin P. Brown; Robert W. Weaver; Joseph R. Swarowski, all of 5935 Emerald Ave., Las Vegas, Nev. 89122

[21] Appl. No.: 549,656

[22] Filed: Oct. 27, 1995

[51] Int. Cl.[6] ..... B21D 7/024

[52] U.S. Cl. ..... 72/130; 72/294; 72/217; 72/161; 72/307

[58] Field of Search ..... 72/307, 294, 129, 72/130, 160, 161, 217–219

[56] References Cited

U.S. PATENT DOCUMENTS

| | | | |
|---|---|---|---|
| 1,048,049 | 12/1912 | Darnell . | |
| 1,096,875 | 5/1914 | Pederquist . | |
| 1,728,109 | 9/1929 | Dalheimer . | |
| 2,293,156 | 8/1942 | Mason | 72/164 |
| 2,310,916 | 2/1943 | Gaines | 72/164 |
| 2,525,590 | 10/1950 | Collins | 198/127 |
| 2,925,170 | 2/1960 | Rath et al. | 203/250 |
| 3,680,347 | 8/1972 | Schenck et al. | 72/217 |
| 3,759,077 | 9/1973 | Hartkopf | 72/99 |
| 3,788,122 | 1/1974 | Ritter | 72/217 |
| 4,235,362 | 11/1980 | Hubenko | 226/181 |
| 4,280,350 | 7/1981 | King et al. | 72/7 |
| 4,724,733 | 2/1988 | Suarez | 72/160 |
| 4,747,293 | 5/1988 | Yagi | 72/307 |
| 4,799,373 | 1/1989 | Benton | 72/307 |
| 5,193,378 | 3/1993 | Ritter et al. | 72/294 |
| 5,195,348 | 3/1993 | Del Fabro | 72/294 |
| 5,228,322 | 7/1993 | Del Fabro et al. | 72/294 |
| 5,285,671 | 2/1994 | Del Fabro et al. | 72/294 |
| 5,355,708 | 10/1994 | Kauffman | 72/294 |

FOREIGN PATENT DOCUMENTS

| | | | |
|---|---|---|---|
| 2232828 | 10/1973 | Germany | 72/217 |
| 737080 | 5/1980 | U.S.S.R. | 72/307 |

OTHER PUBLICATIONS

Digital Machine International drawing dated Sep. 21, 1981.

Rebar Machine Services, Inc. drawing dated Dec. 20, 1990.

Photograph of Ergon machine shown at World of Concrete trade show in Houston in 1990.

Brochure (undated) of KRB Fabmatic fabricating machine for straight bar.

Brochure (undated) of the Schnell fabricating machine.

Brochure (undated) of the Gonia bending machine.

*Primary Examiner*—Daniel C. Crane

*Attorney, Agent, or Firm*—John Edward Roethel

[57] ABSTRACT

A rebar fabricating machine is provided that is capable of processing either straight rod stock material or coil stock material. The rebar fabricating machine comprises a main cabinet, a horizontal power driven straightening module mounted adjacent to the upstream end of the main cabinet, a main drive module, a vertical straightening module, an encoder roll, a shear device and a bending head all mounted on the interior of the main cabinet. The main drive module includes a plurality of upper rolls each having a hydraulic cylinder attached thereto and a plurality of lower driven rolls driven by a single drive motor. The vertical straightening module includes a plurality of adjustable upper and lower straightening rolls. The horizontal straightening module is pivotally mounted on a base so that the horizontal straightening module can be selectively removed from the path of travel of the stock material. A swing up door is mounted on the main cabinet adjacent the main drive module so that when the swing up door is open, power to the hydraulic cylinder attached to each upper roll is interrupted so that the stock material cannot be fed into the fabricating machine. The entire apparatus is operated using an electronic computerized controller that connects each hydraulic cylinder through a common manifold to a single source of hydraulic pressure.

10 Claims, 14 Drawing Sheets

REBAR FABRICATING APPARATUS

This invention relates to rebar fabricating apparatus, and more particularly to rebar fabricating apparatus that can fabricate stock material fed to the apparatus as either straight rod stock or coiled stock of any length.

BACKGROUND OF THE INVENTION

Steel reinforcing bar ("rebar") has been used for many years to reinforce poured concrete used in the construction of concrete structures such as bridges, roadways and building columns. While straight rebar rod can be used in that shape in some applications, other applications require that the rebar be fabricated into various shapes depending on the shape of the concrete to be reinforced. Sometimes, the rebar is bent to act as tie rods to hold two or more straight rebar rods together. Other times, the rebar is formed into intricate shapes as the main reinforcement for the concrete.

Many automatic bending machines have been developed over the years to fabricate rebar stock material into the shapes needed. Fairly representative of the prior art is the bending machine shown in U.S. Pat. No. 3,680,347 to Schenck et al.

The Schenck device shows a large reel that carries coiled rebar stock which is to be unwound from the coil and fed into the bending machine. The bending machine includes a cabinet that holds the drive and control means for operating the various elements of the bending machine. Typically, a pair of feed rolls picks up the coiled stock from the large reel and feeds the stock through a series of straightening rolls, through a pair of metering rolls and into the bending head. In response to commands from the electronic controls, the bending head performs a series of eccentric bends to effect the shaping of the stock into the desired configuration, the stock is cut by a shearing device and the rebar piece is finished.

Other rebar fabricating machines have been designed to be used exclusively with straight rod stock. Representative of this prior art is the apparatus shown in U.S. Pat. No. 5,255,708 to Kauffman. The Kauffman device shows a rod stock loader positioned at one end of the cabinet of the bending machine. The rod stock is loaded into a pair of feed rolls and then passes down a channel, into a secondary pair of feed rolls, past a shear head and into a bending head. The bending head, in response to commands from the electronic controls, performs one or more bending operations to create the desired shape of the rebar and the stock is cut to length by a shearing device to create the finished rebar piece.

Bending machine manufacturers have traditionally marketed their products for use either with coiled rod stock or straight rod stock. Unfortunately, the market price of rod stock fluctuates and from time to time coiled stock will be less expensive per foot than straight rod stock and at other times the straight rod stock will be less expensive per foot than coiled stock. Thus, the company that uses a bending machine to fabricate rebar segments either must incur the expense of having two bending machines—one for coil stock and one for straight rod stock—or suffer an economic disadvantage when the price of the stock material for their particular type of bending machine is higher than the price for the other type of stock material.

The present invention is designed to overcome these drawbacks of the prior art machines by providing a machine that can process both available types of stock material—coil stock and straight rod stock. A company using the machine of the present invention can select the most economical steel stock material, depending on the market price or availability, for a particular job. If a particular job requires a particular type of steel, the company can easily use the proper steel without a concern as to whether that steel is available in straight rod stock or coil stock. Full flexibility is provided by one machine so that there is no need to be changing from a straight rod stock machine to a coil stock machine and back depending on the particular job requirements. The company can purchase a single machine that effectively does the work of two conventional rebar fabricating machines.

It is an object of the present invention to provide a single rebar fabricating machine that can process both straight rod stock and coil stock by simply changing the type of stock material that is being fed to the machine.

It is a feature of the present invention that a rebar fabricating machine is provided with a horizontal straightening roll module, a drive module, a vertical straightening roll module, an encoder roll, a shearing device and a bending head combined together in a single machine in a particular orientation so that either straight rod stock or coil stock can be fed through the machine for fabrication of rebar pieces.

It is an advantage of the present invention that a manufacturer of rebar pieces can have a single rebar fabricating machine that can handle either straight rod stock or coil stock so that the rebar pieces can be manufactured using the most economical stock material depending on price and availability as well as need for a particular order.

Other objects, features and advantages of the present invention will become apparent from a consideration of the following detailed description.

SUMMARY OF THE INVENTION

A rebar fabricating machine is provided that is capable of processing either straight rod stock material or coil stock material. The rebar fabricating machine comprises a main cabinet, a horizontal power driven straightening module mounted adjacent to the upstream end of the main cabinet, a main drive module mounted on the interior of the main cabinet and downstream from the horizontal straightening module, a vertical straightening module mounted on the interior of the main cabinet and downstream from the main drive module, a shear device mounted on the interior of the main cabinet and downstream from the vertical straightening module and a bending head mounted on the interior of the main cabinet and downstream from the shear device. The main drive module includes a plurality of upper rolls each having a hydraulic cylinder attached thereto and a plurality of lower driven rolls driven by a single drive motor. The vertical straightening module includes a plurality of adjustable upper and lower straightening rolls. The horizontal straightening module is pivotally mounted on a base so that the horizontal straightening module can be selectively removed from the path of travel of the stock material when straight rod stock material is being fed. A swing up door is mounted on the main cabinet in front of the main drive module so that when the swing up door is open, power to the hydraulic cylinder attached to each upper roll is interrupted so that the stock material cannot be driven through the fabricating machine. The entire apparatus is operated using an electronic computerized controller that connects each hydraulic cylinder through a common manifold to a single source of hydraulic pressure.

DETAILED DESCRIPTION OF THE PREFERRED EMBODIMENTS

Figure 1:
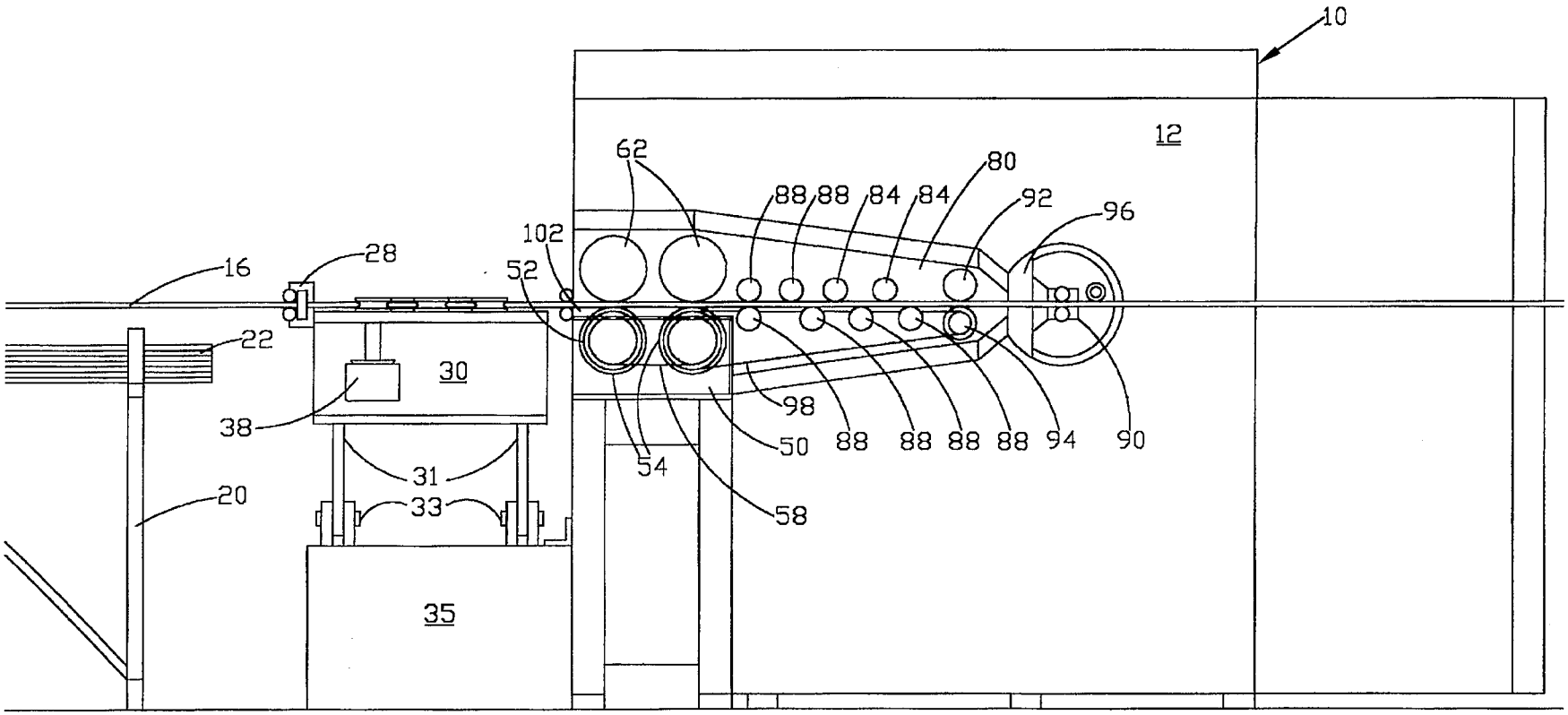
FIG. 1 is a front view in cutaway of the rebar fabricating machine of the present invention.
Figure 2:
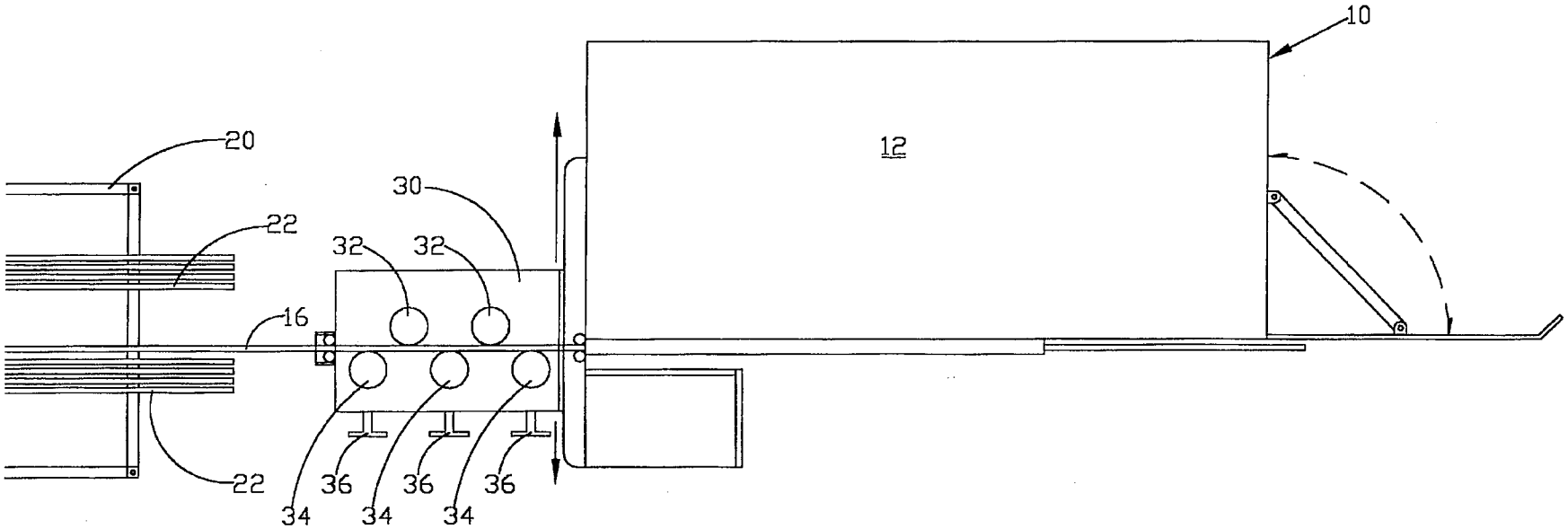
FIG. 2 is a top view partially in cutaway of the rebar fabricating machine of the present invention.

The rebar fabricating machine of the present invention is shown generally at 10 in FIGS. 1 and 2. The rebar fabricating machine 10 can be fed using either coil stock 16 stored on a conventional coil stock reel (not shown) or with straight rod stock 22 stored on a straight rod stock cradle 20 adjacent the entry end of the main cabinet 12 of the rebar fabricating machine 10. Whenever reference is made in this specification and the accompanying claims to the term "stock material", it is to be understood that the term "stock material" is intended to cover both straight rod stock material 22 and coil stock material 16.

The rebar fabricating machine 10 comprises a horizontal straightening module 30 positioned adjacent the entry end of the main cabinet 12. The main cabinet 12 contains the main drive module 50, the vertical straightening module 80, the encoder roll 92 is located above the exit drive roll 94, a shear head 96 and the bending head 90. The entire rebar fabricating machine 10 is operated by means of an electronic and hydraulic control system as will be explained herein.

As shown in FIGS. 1 and 2, the rebar fabricating machine 10 is being fed with coil stock 16 which first passes through a pair of entry guide rolls 28 and then enters into the horizontal straightening module 30. The horizontal straightening module 30 is mounted on a pair of legs 31 which are connected by pivots 33 to a base 35. This allows the horizontal straightening module 30 to be pivoted out of the feed line when straight rod stock material 22 is being fed to the rebar fabricating machine 10 since straight rod stock material 22 normally does not need to be horizontally straightened whereas coil stock material 16 does normally need horizontal straightening to compensate for the effect of the coil stock 16 being wound on the coil stock reel (not shown).

Figure 4:
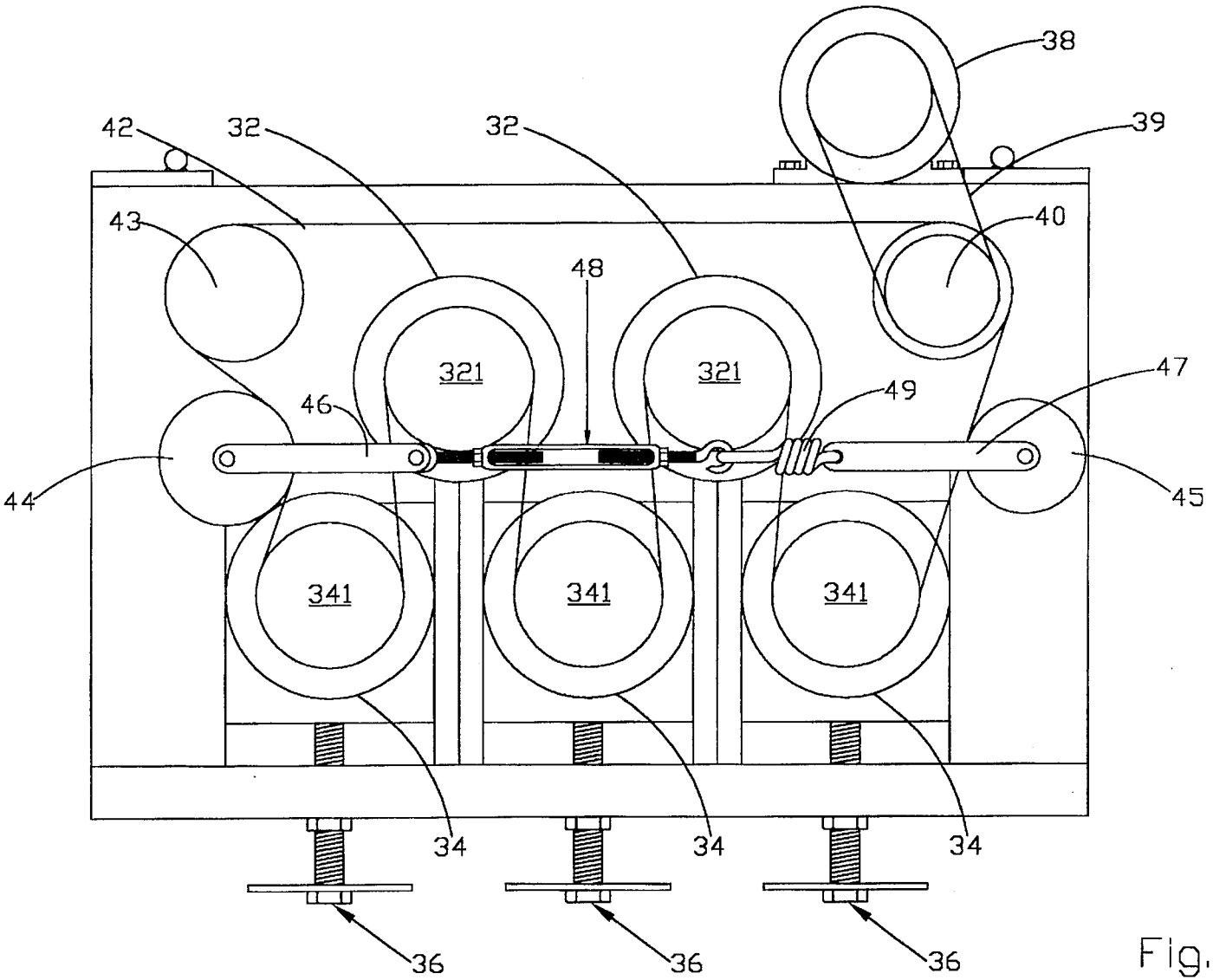
FIG. 4 is a top view of the horizontal straightening module of the rebar fabricating machine of the present invention.
Figure 5:
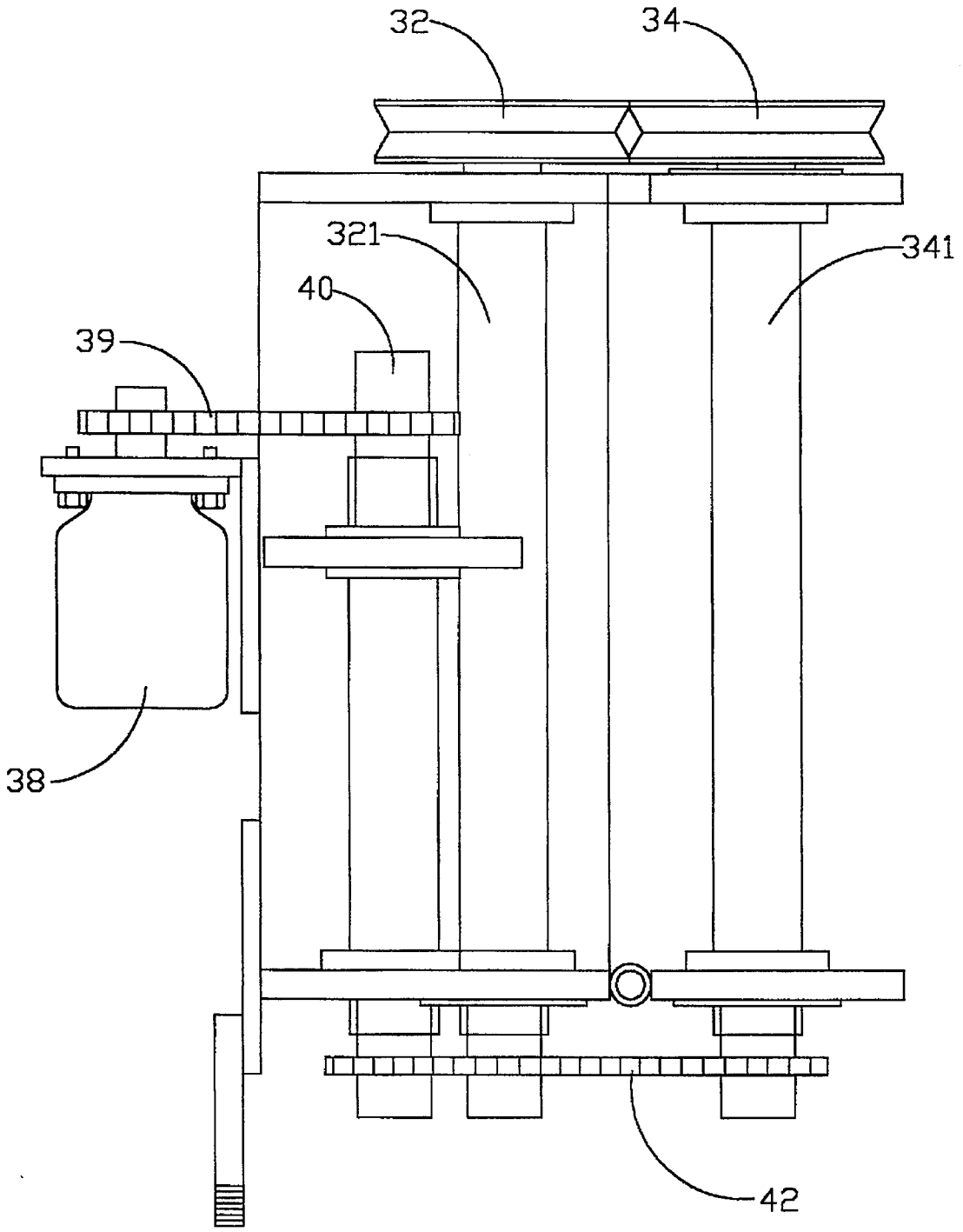
FIG. 5 is a side view of a portion of the horizontal straightening module.
Figure 6:
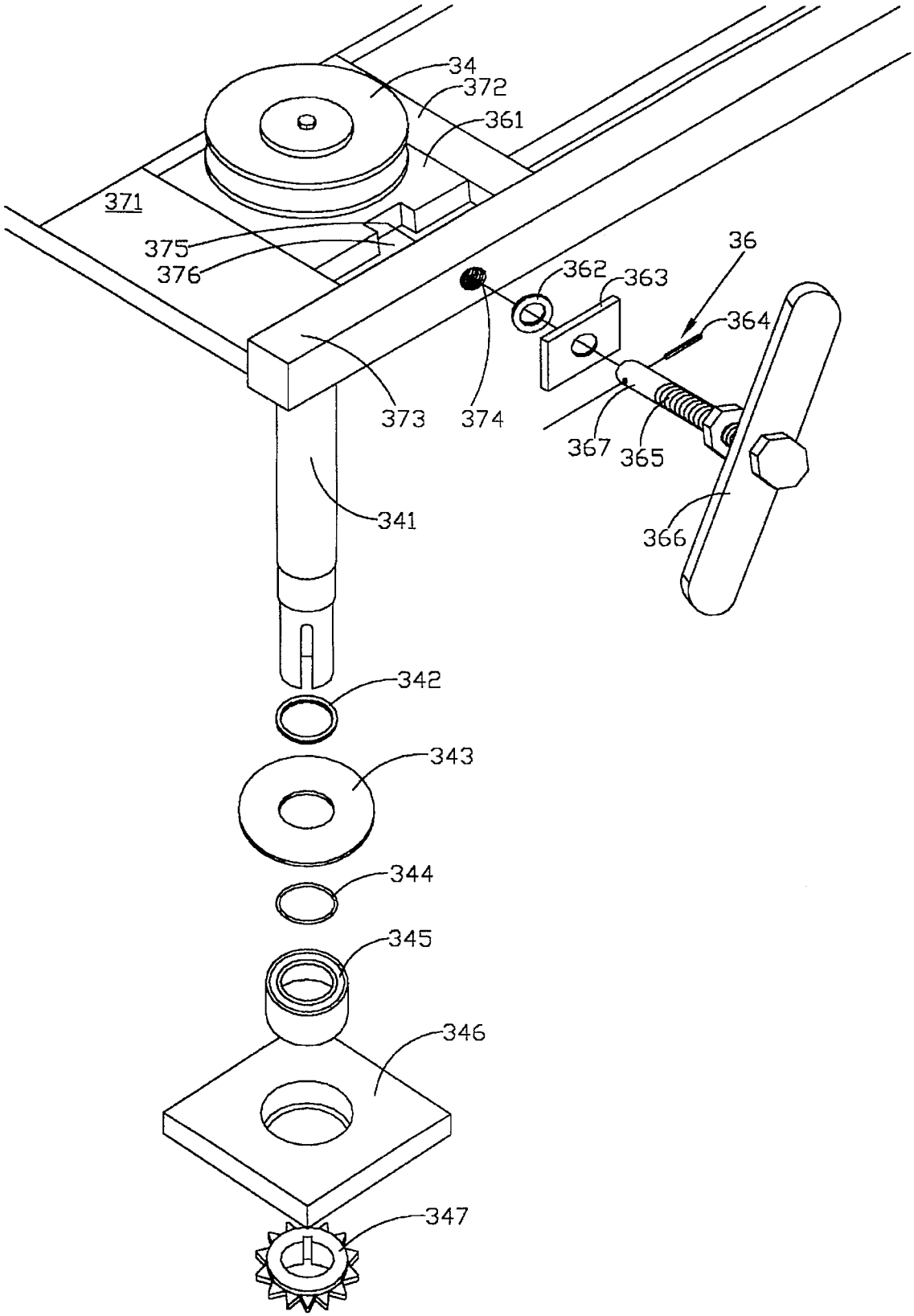
FIG. 6 is an exploded view of a portion of the horizontal straightening module.

FIGS. 4, 5 and 6 show the details of the horizontal straightening module 30. The horizontal straightening module 30 comprises a plurality of fixed straightening rolls 32 and adjustable straightening rolls 34, preferably two fixed straightening rolls 32 and three adjustable straightening rolls 34. Each of the fixed straightening rolls 32 and adjustable straightening rolls 34 are driven by means of the drive motor 38. The drive motor 38 is connected by the drive motor chain 39 to the drive motor shaft 40 which in turn is connected to a drive shaft 321 extending down from each of the fixed straightening rolls 32 and to a drive shaft 341 extending down from each of the adjustable straightening rolls 34.

Also as shown in FIG. 4, there are a first tensioning sprocket 44 and a second tensioning sprocket 45 at opposite ends of the horizontal straightening module 30. The first tensioning sprocket 44 and the second tensioning sprocket 45 are joined together for simultaneous motion by means of a pair of arms 46,47, a turnbuckle 48 and a spring 49. The two tensioning sprockets 44,45 take up any slack in the first drive chain 42 and maintain the first drive chain 42 tightly against each of the drive shafts 321 and the idler shafts 341 as the stock material is fed through the main cabinet 12. FIG. 4 shows the positioning of the two tensioning sprockets 44,45 during the infeed of the stock material. In the event the drive motor 38 needs to reversed to withdraw stock material, the two tensioning sprockets 44,45 shift laterally so that the second tensioning sprocket 45 engages the first drive chain 42 to provide tension from that end of the horizontal straightening module 30.

The drive motor 38 acting through the first drive chain 42 effects rotation of each of the fixed straightening rolls 32 and adjustable straightening rolls 34. This arrangement ensures the fixed straightening rolls 32 and adjustable straightening rolls 34 turn together to advance the stock material at a uniform rate through the main cabinet 12.

The adjustment for each of the adjustable straightening rolls 34 is effected by the adjusters 36. As shown in FIG. 6, an adjustable straightening roll 34 is mounted for rotation on a slider plate 361 which is held in place in the horizontal straightening module 30 between the left side plate 371 and the right side plate 372. On the lateral edge of the horizontal straightening module 30 there is provided an end plate 373 with a threaded aperture 374 therein aligned with a recess 375 in the slider plate 361. The slider plate 361 does not fill the entire space between the left side plate 371, the right side plate 372 and the end plate 373 leaving a gap 376.

The slider plate adjustment bolt 365 with its accompanying handle 366 slides into the aperture 374 with the unthreaded end piece 367 extending into the gap 376. The washer 362 and spacer 363 are positioned on the unthreaded end piece 367 and a split pin 364 fits through an aperture in the unthreaded end piece 367 to hold the washer 362 and spacer 363 in place. In the assembled position, the butt end of the unthreaded end piece 367 acts against the slider plate 361 at the recess 375 so that as the adjuster 36 is turned clockwise or counterclockwise, the slider plate 361 can be moved to adjust its lateral position between the left side plate 371 and right side plate 372.

This lateral adjustment of the adjustable straightening rolls 34 shown in FIG. 4 is also accommodated by the assembly of the idler shaft 341 into the lower areas of the horizontal straightening module 30. The lower end of the idler shaft 341 is slotted into a sprocket 347 which engages the first drive chain 42. A double bearing 345 is positioned in the bottom bearing holder pivot plate 346 and the idler shaft 341 is journalled in the double bearing 345 using the O-ring 342, the bearing dust guard 343 and the O-ring 344.

Figure 3:
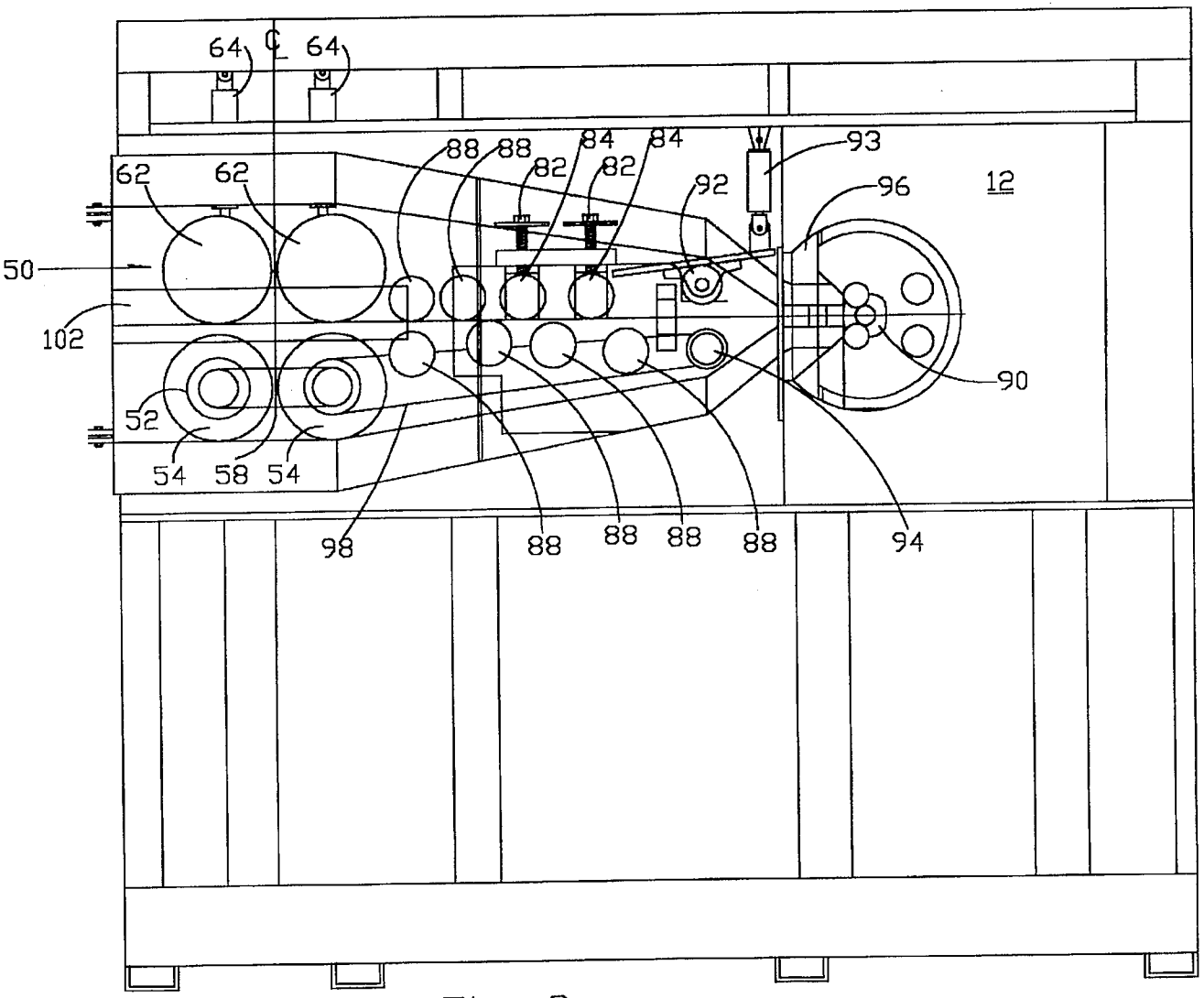
FIG. 3 is a sectional front view of the main drive module, the vertical straightening module and the bending head of the rebar fabricating machine of the present invention.

With reference to FIG. 3, after the coil stock 16 passes through the horizontal straightening module 30, it enters the main drive module 50 mounted on the interior of the main cabinet 12. The main drive module 50 pushes the coil stock 16 through the rest of the components of the rebar fabricating machine 10 which are also mounted on the interior of the main cabinet 12. The main drive module 50 comprises a pair of lower rolls 54 connected by a second drive chain 58 on the lower side of the coil stock 16 and a pair of upper rolls 62 mounted to contact the upper side of the coil stock 16.

Figure 7:
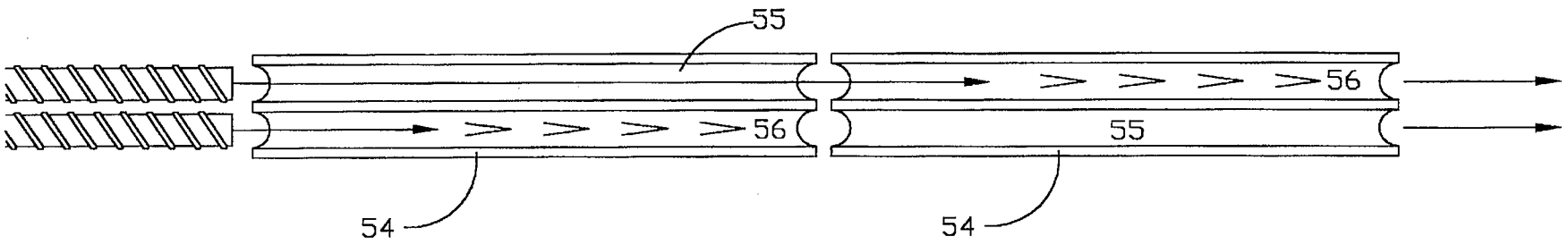
FIG. 7 is a top view of two of the adjustable lower drive rolls of the present invention.
Figure 8:
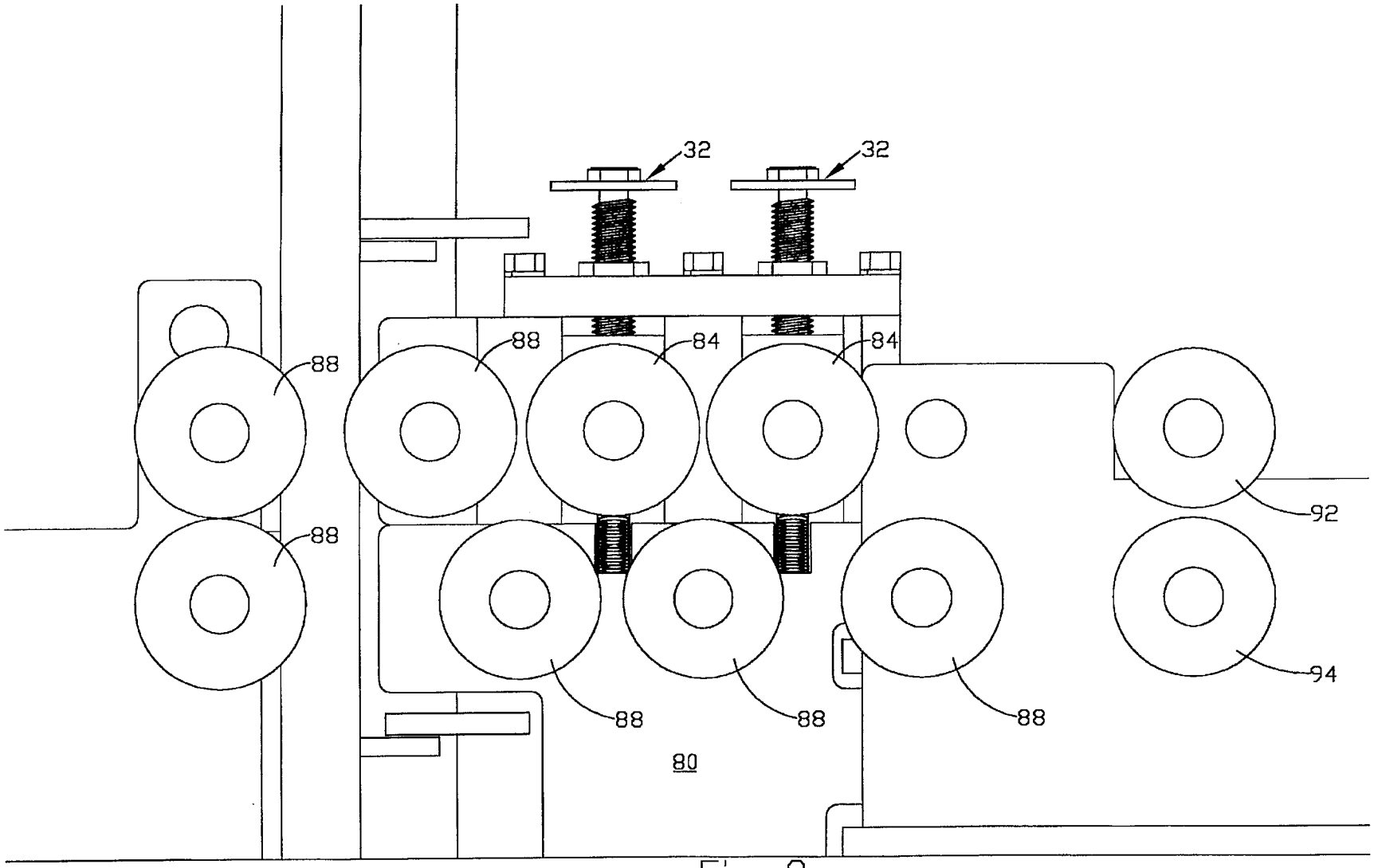
FIG. 8 is a side view of the vertical straightening module of the rebar fabricating machine of the present invention.

As shown in FIG. 7, each lower roll 54 is preferably a double channeled design to accommodate dual feeding of stock material. Each lower roll 54 has a deep groove 55 and a shallow groove 56 which are positioned side-by-side with the deep groove 55 being on the inside on the first roll and the outside on the second roll (or vice versa). By alternating the deep groove 55 with the shallow groove 56, a positive grip is maintained on the stock material regardless of the diameter of the stock material. Additionally, each groove is preferably provided with serrations along the bottom of each groove to assist in gripping the rod stock.

The two lower rolls 54 are joined together at their shafts by the second drive chain 58 which is connected to a drive motor 52. Thus, each lower roll 54 is a power driven roll and the two lower rolls 54 rotate at the same speed due to the second drive chain 58 being driven by the drive motor 52.

Each upper roll 62 is mounted on a hydraulic cylinder 64 that adjusts the pressure being applied to the stock material by the upper roll 62.

When the stock material exits the main drive module 50, it next comes into contact with the vertical straightening module 80 which effects a vertical straightening of the stock material. The vertical straightening module 80 comprises a plurality of first rolls 84 and second rolls 88. Each of the first rolls 88 are adjustable by means of manual adjustments on the shafts thereof and each of the second rolls 84 are fully adjustable by means of the adjuster 82 mounted to each of the second rolls 84. The adjusters 82 are assembled to the second rolls 84 in a manner similar to the adjuster 36 assembly shown in FIG. 4.

After the stock material passes through the vertical straightening module, the stock material is further advanced by the exit drive roll 94 which rests on the under side of the stock material. The exit drive roll 94 is driven by the same drive motor 52 that drives the lower rolls 54 and is attached to the lower rolls 54 by means of the third drive chain 98. This also ensures that the rotation of the exit drive roll 94 is at the same speed as the lower rolls 54.

On the top side of the stock material opposite the exit drive roll 94 is an encoder roll 92. The encoder roll 92 measures the movement of the stock material and the pressure applied to the stock material by the encoder roll 92 is determined by the air cylinder 93 attached to the encoder roll 92.

The stock material passes through the shear device and finally is fed into the bending head 90 which can be any of suitable bending head. The rotation of the bending head 90 in response to commands from the computer control system creates the final shape of the finished rebar piece. After the bending head 90 creates the bends in the stock material, a shear device 96 cuts the stock material to its final length creating the final finished rebar piece. After the cutting step has occurred, the next segment of the stock material is advanced into the bending head 90 so that the next finished rebar piece can be created.

Figure 9:
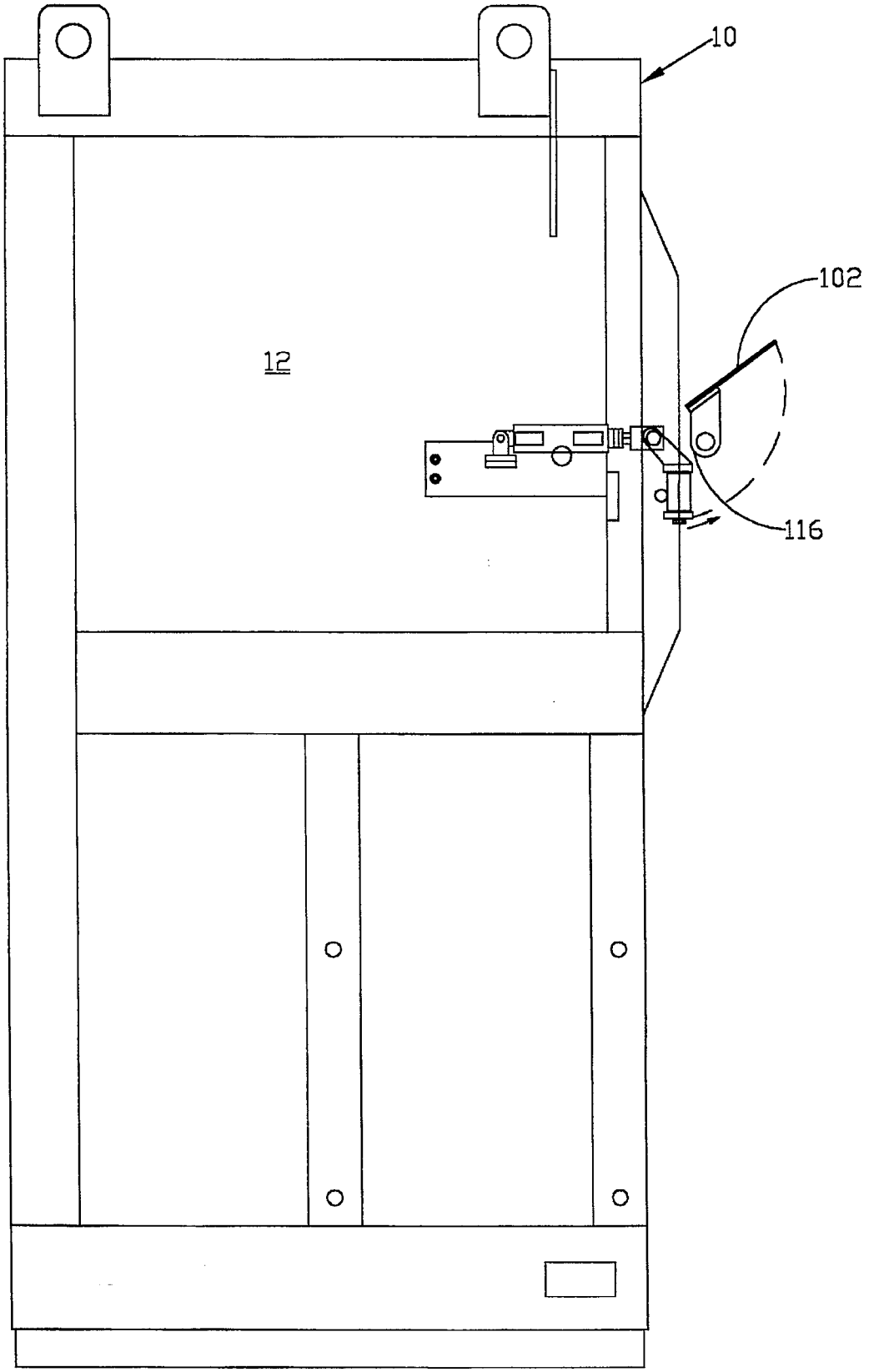
FIG. 9 is an end view showing the details of the swing up safety door adjacent the main drive module.
Figure 10:
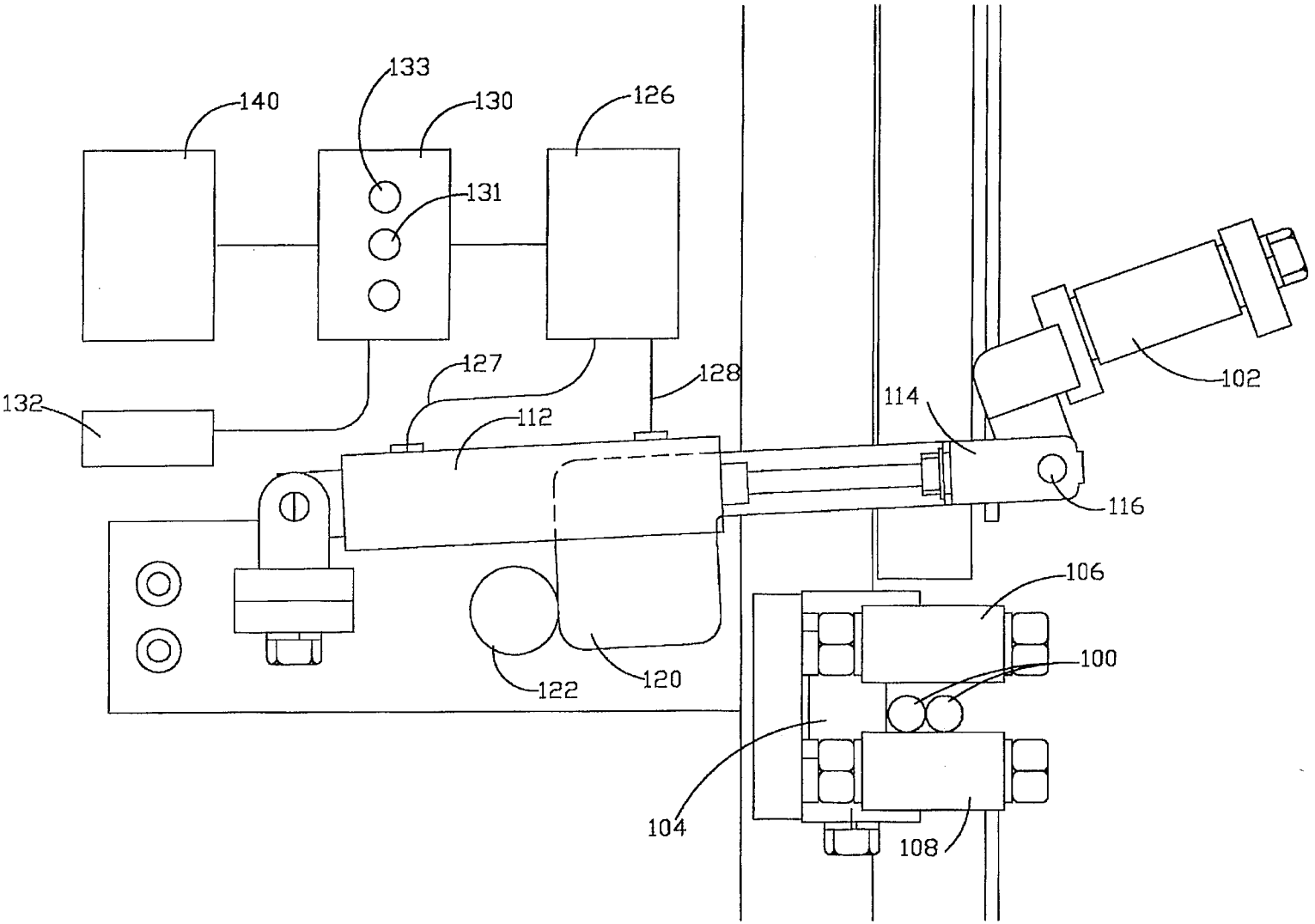
FIG. 10 is an end view showing the swing up safety door in the open position.
Figure 11:
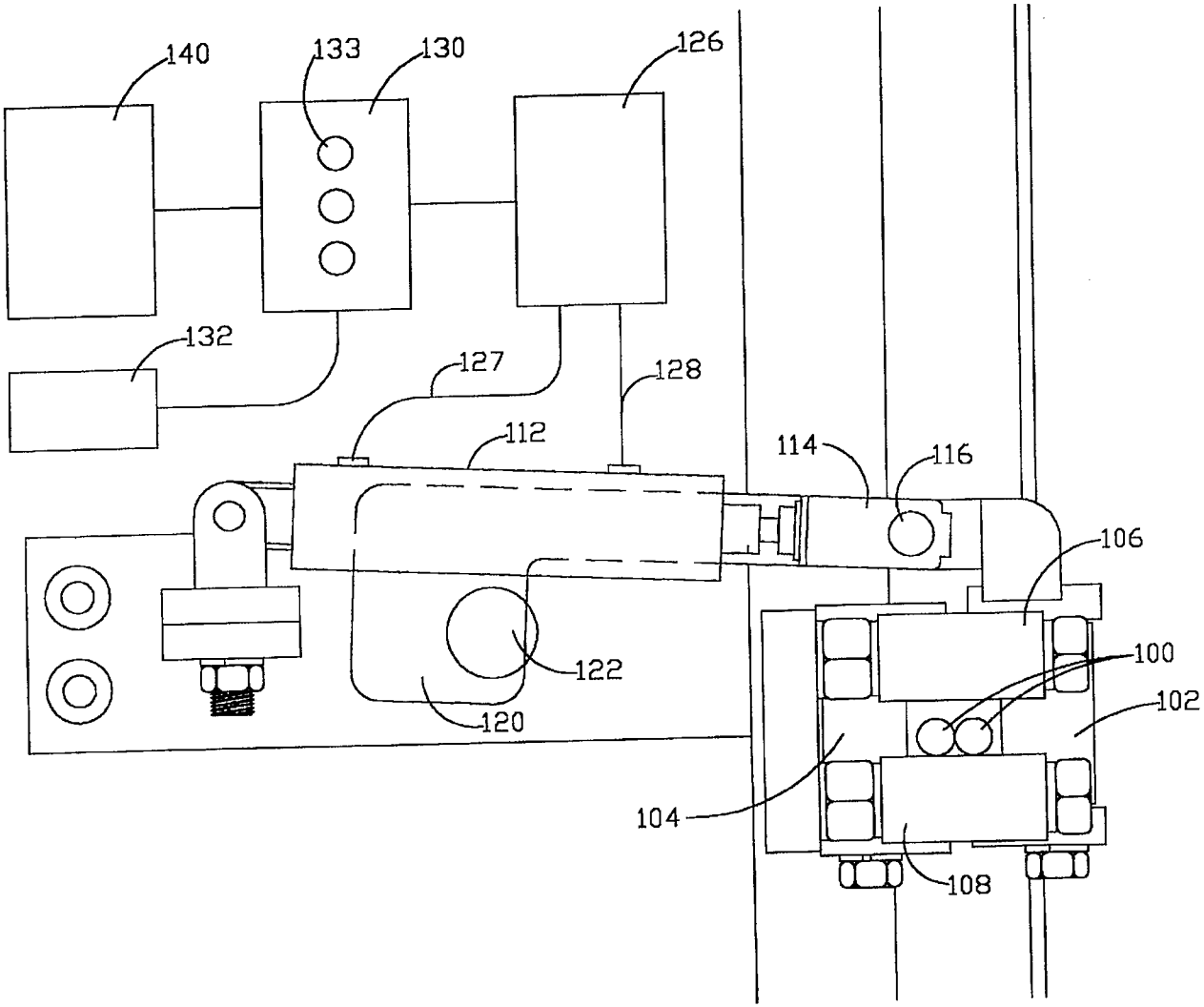
FIG. 11 is an end view showing the swing up safety door in the closed position.

The details of the swing up safety door 102 are shown in FIGS. 9, 10 and 11. The swing up door 102 is mounted on the front of the cabinet 12 of the rebar fabricating machine 10 at a position directly in front of the main drive module 50. The swing up door 102 pivots about a hinge 116 between its open position shown in FIGS. 9 and 10 and its closed position shown in FIG. 11. The swing up door 102 provides access to the stock material 100 (shown in FIGS. 10 and 11 as being dual fed through the main cabinet 12). The inside guide roll 104, top guide roll 106 and bottom guide roll 108 act to position and guide the stock material during feeding. The opening and closing of the swing up door 102 is effected by the air cylinder 112 which has a cylinder arm 114 connected through hinge 116 to the swing up door 102.

During initial start up of the rebar fabricating machine 10, the swing up door 102 is in the open position as shown. This allows the operator to initially position the stock material 100 to be processed in the start up location relative to the main drive module 50. As long as the swing up door 102 is in the open position, each of the hydraulic cylinders 64 that are connected to the upper rolls 62 are disengaged and the upper rolls 62 are incapable of applying pressure to the stock material.

Also, when the door 102 is in the open position, the foot switch 132 is active. After the stock material 100 has been properly positioned by the operator, the operator can press on the foot switch 132 which releases each of the upper rolls 62 which then slowly drop into contact with the stock material 100. There is enough residual hydraulic pressure in the system to lower the upper rolls 62, but not enough hydraulic pressure to provide any significant pressure to the stock material 100. The slight weight of the upper rolls 62 on the stock material 100 is enough to hold the stock material 100 in place until the door 102 is closed, but not enough to injure the operator if he should inadvertently have his hand or fingers between the stock material 100 and the upper rolls. The stock material 100 cannot be fed through the main cabinet 12 until the door 102 is closed and full pressure is applied by the upper rolls 62.

In order to close the swing up door 102, the operator presses the "close" button 131 on the operating panel box 130 which activates the air valve 126 to send air through the "close door" line 128 into the air cylinder 112. This causes the cylinder arm 114 to move backward causing the swing up door 102 to pivot around the hinge 116 and close as shown in FIG. 11. The movement of the cylinder arm 114 backward also causes the sensor arm 120 to cover the proximity switch 122. The proximity switch 122 sends a signal to the controller 140 alerting the control system that the swing up door 102 is closed. This allows the foot switch 132 to become inactive.

When the swing up door 102 is closed and such closure is recognized by the proximity switch 122, the foot switch 132 is de-activated and a sensor maintains a low pressure on the stock material through the upper rolls 62. The operator may then press the "run" button which allows each of the hydraulic cylinders 64 to activate its associated upper roll 62 so that the stock material may be driven forward through the vertical straightening module 80 and into the shear device 96/bending head 90.

When it is desired to open the swing up door 102, the operator presses the open button 131 which causes the air valve 126 to inject air pressure through the "open door" line 127 from the air cylinder 112. This causes the cylinder arm 114 to move forward and open the swing up door 102.

Figure 12:
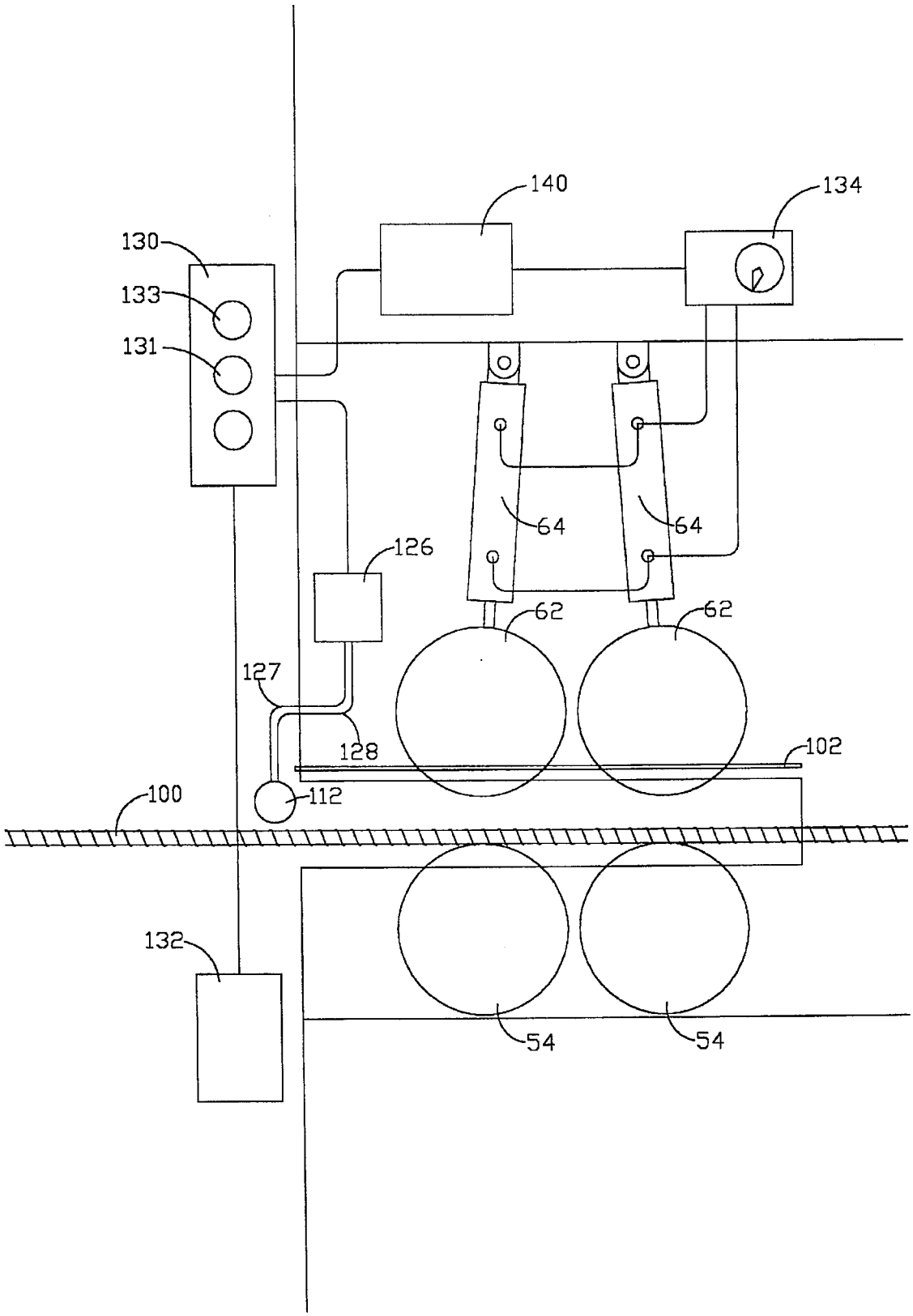
FIG. 12 is a front view of the main drive module with the upper rolls in the non-pressure position with the safety door open.
Figure 13:
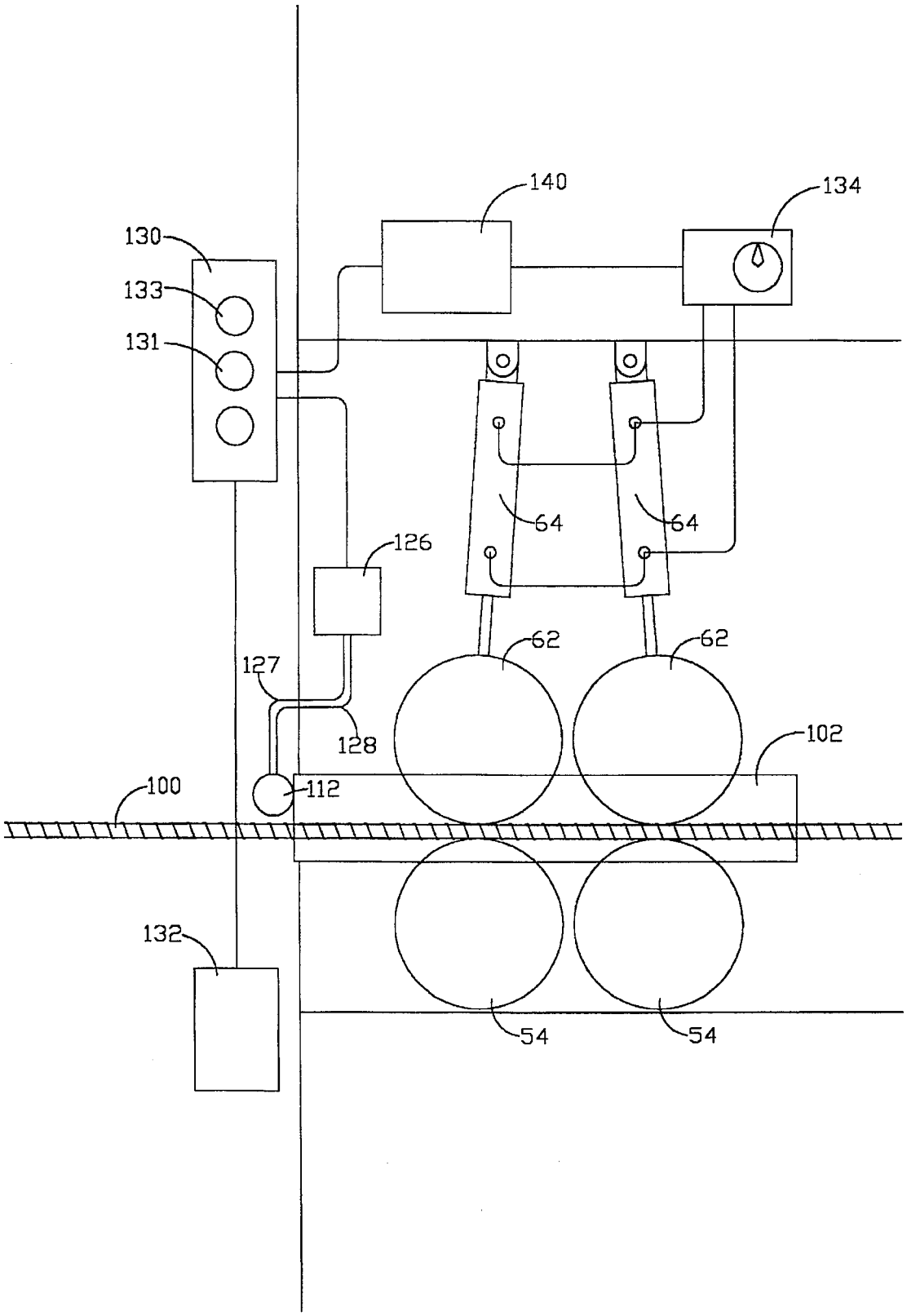
FIG. 13 is a front view of the main drive module with the upper rolls in the pressure position with the safety door closed.

FIGS. 12 and 13 show respectively the position of the upper rolls 62 in both the "open" and "closed" positions of the swing up door 102. In the "open" position, the hydraulic cylinders 64 are both raised which lift the upper roll 62 off of the stock material 100. The stock material 100 therefore cannot be driven through the main cabinet 12 so that the operator may safely reach in between the upper roll 62 and hydraulic cylinder 64 to position the stock material 100 if necessary. Because the swing up door 102 is open, the sensor arm 120 is not in contact with the proximity switch 122 so the foot switch 132 is active.

In order to close the swing up door 102, the operator must reach up and press the open/close button 131 that closes the swing up door 102. If the swing up door 102 closes fully, the sensor arm 120 is now in contact with the proximity switch 122 which tells the controller 140 that the swing up door 102 is closed. This causes the foot switch 132 to be inactive and the controller 140 causes the clamping valve 134 to maintain clamping residual pressure in the hydraulic cylinder 64 to hold the upper roll 62 in contact with the stock material 100.

Figure 14:
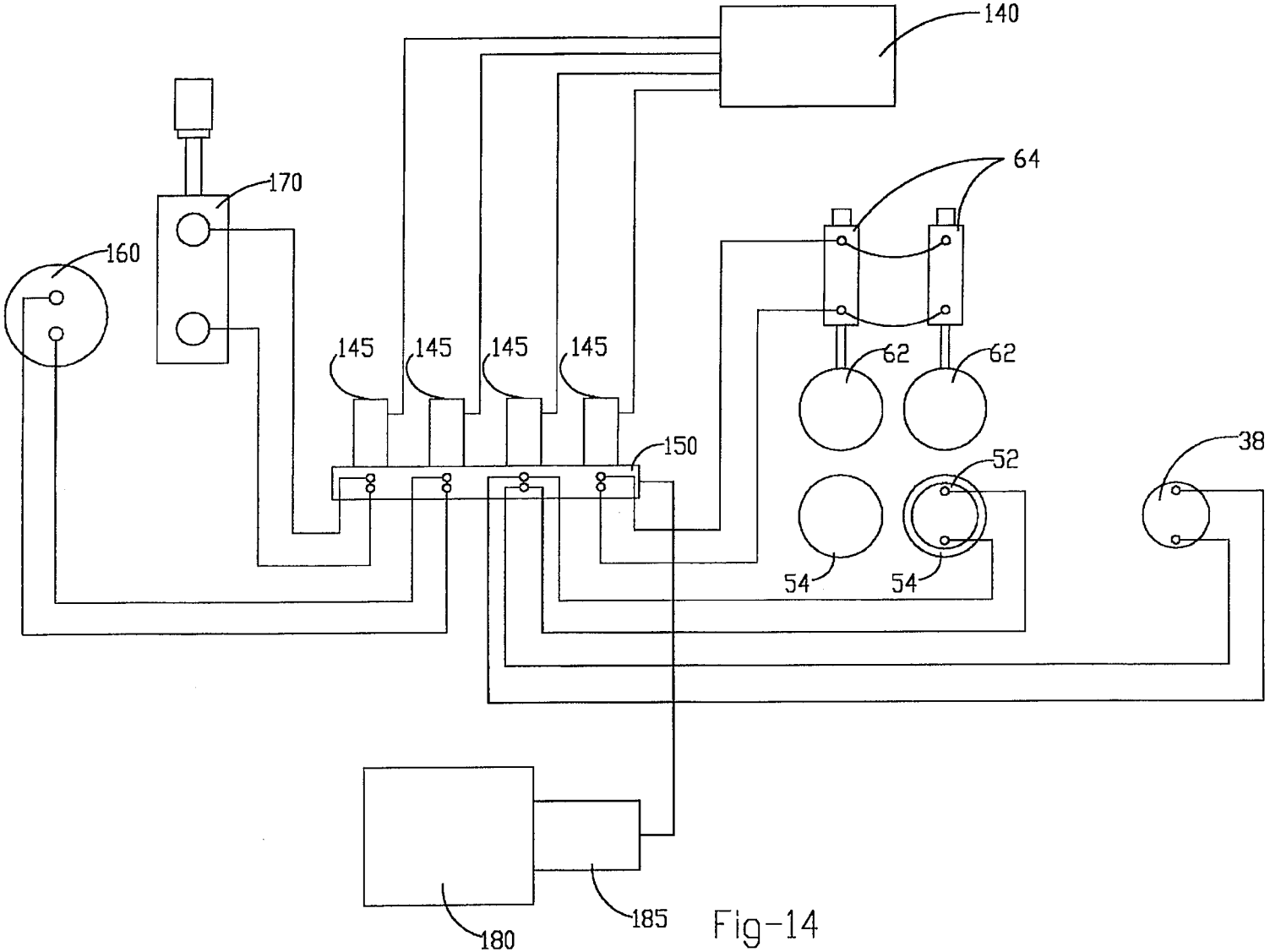
FIG. 14 is a schematic representation of the control system of the rebar fabricating machine of the present invention.

FIG. 14 shows schematically the hydraulic operating system for the rebar fabricating machine 10 of the present invention. The entire rebar fabricating machine 10 is powered by a hydraulic pump 185 operated by an electric motor 180. A common manifold block 150 connects all of the hydraulically operated components of the rebar fabricating machine 10. The use of this common manifold block 150 ensures that the hydraulic pressure throughout the system is uniformly distributed subject to the operation of the controller 140.

The manifold block 150 provides hydraulic connection to the drive motor 38 and the drive motor 52 from a common pressure control valve 145 so that both the drive motor 38 and the drive motor 52 receive equal amounts of hydraulic pressure so the rotational speed of these motors is the same. Separate manifold connections are provided for the hydraulic cylinders 64, the hydraulic bending motor 160 and the hydraulic shear cylinder 170 through the respective pressure control valve 145. In the preferred embodiment, each pressure control valve 145 is a high response proportional directional control valve with an internal linear variable differential transformer spool feedback for low hysteresis which gives precise positioning and extremely accurate control. The provision of a feedback transducer allows constant monitoring of the valve position so that the operation of the valve is highly repeatable. Representative of such a control valve is Model #D31FSE01B4NXPO distributed by Fornaciari Co. of Santa Fe Springs, Calif.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A rebar fabricating machine capable of processing either straight rod stock material or coil stock material comprising:

a) a main cabinet;

b) a horizontal straightening module mounted adjacent an upstream end of the main cabinet; the horizontal straightening module including a plurality of adjustable straightening rolls driven by a single first drive motor for straightening the stock material; the straightening rolls being horizontally arranged so that their rotation axes extend vertically; the horizontal straightening module being pivotally mounted on a base so that the horizontal straightening module can be selectively removed from the path of travel of the stock material;

c) a main drive module mounted on the interior of the main cabinet and downstream from the horizontal straightening module for drivingly feeding the stock material, the main drive module including a plurality of upper rolls each having a hydraulic cylinder attached thereto and a plurality of lower driven rolls driven by a second drive motor, the hydraulic cylinders mounted so as to adjust the pressure applied against the stock material between the upper and lower rolls;

d) a vertical straightening module mounted on the interior of the main cabinet and downstream from the main drive module, the vertical straightening module including a plurality of adjustable straightening rolls, the vertical straightening rolls being arranged so that their rotation axes extend horizontally;

e) an exit drive roll and an encoder roll located above the exit drive roll for drivingly feeding the stock material, each mounted on the interior of the main cabinet and downstream from the vertical straightening module, the exit drive roll being driven by the second drive motor;

f) a shear device for shearing the stock material mounted on the interior of the main cabinet and downstream from the exit drive roll; and g) a bending head for bending the stock material mounted on the interior of the main cabinet and downstream from the shear device.

2. The rebar fabricating machine of claim 1 wherein the horizontal straightening module includes the first drive motor connected by a drive motor chain to a drive motor shaft, the drive motor shaft connected by a first drive chain to the adjustable straightening rolls, the drive chain further having associated therewith a tensioning device to maintain the tension on the drive motor chain in both its forward and reverse directions.

3. The rebar fabricating machine of claim 2 wherein the tensioning device includes a first tensioning roll having an arm thereon, a second tensioning roll having an arm thereon and a spring and turnbuckle connecting the arm of the first tensioning roll to the arm of the second tensioning roll.

4. The rebar fabricating machine of claim 1 wherein the main drive module comprises:

a) a first lower roll having two channels thereon, a first inside channel having a deep groove and a second outside channel having a shallow groove; and b) a second lower roll having two channels thereon, a first inside channel having a shallow groove and a second outside channel having a deep groove whereby when two lengths of stock material are fed simultaneously through the rebar fabricating machine, both lengths of stock will be securely gripped by the lower drive rolls regardless of the diameters of the stock material.

5. The rebar fabricating machine of claim 1 further including a swing up door mounted on the main cabinet in front of the main drive module whereby when the swing up door is open, power to the hydraulic cylinder attached to each upper roll is interrupted so that the stock material cannot be driven through the fabricating machine.

6. The rebar fabricating machine of claim 5 further including:

a) an air cylinder connected to the swing up door;

b) an air valve connected to the air cylinder, the air valve having an open door line for opening the swing up door and a close door line for closing the swing up door;

c) a sensor arm mounted to the air cylinder and associated with a proximity switch so that the proximity switch can detect the sensor arm when the swing up door is in the closed position; and d) an operating panel box whereby an operator can activate the air cylinder to open and close the swing up door.

7. The rebar fabricating machine of claim 6 further including a foot switch connected to the operating panel box so that the operator can lower the upper rolls into slight contact with the stock material to hold the stock material in place while the swing up door is open.

8. The rebar fabricating machine of claim 1 further including an electric motor, an hydraulic pump and a single manifold block connected to all of the hydraulic components used in the rebar fabricating machine so that a single source of system pressure is used through the machine whereby the hydraulic pressure is uniformly distributed by a controller.

9. The rebar fabricating machine of claim 8 wherein the first drive motor is hydraulic and the second drive motor is hydraulic, and both drive motors are connected to a common pressure control valve on the manifold so that the rotational speed of each drive motor is the same.

10. The rebar fabricating machine of claim 9 wherein the pressure control valve is a high response proportional directional control valve having an internal linear variable differential transformer spool feedback whereby low hysteresis is encountered so that precise positioning and accurate control are obtained.

* * * * *